United States Patent [19]

Woodward et al.

[11] 4,062,019

[45] Dec. 6, 1977

[54] LOW COST LINEAR/CIRCULARLY POLARIZED ANTENNA

[75] Inventors: Oakley McDonald Woodward, Princeton; Matti Solmu Olavi Siukola, Westmont, both of N.J.

[73] Assignee: RCA Corporation, New York, N.Y.

[21] Appl. No.: 672,859

[22] Filed: Apr. 2, 1976

[51] Int. Cl.[2] ..... H01A 21/26

[52] U.S. Cl. ..... 343/797; 343/802; 343/806

[58] Field of Search ..... 343/797, 821, 890, 802, 343/806

[56] References Cited

U.S. PATENT DOCUMENTS

| | | | |
|---|---|---|---|
| 2,847,670 | 8/1958 | Cox | 343/821 |
| 2,976,534 | 3/1961 | Kampinsky | 343/797 |
| 3,413,644 | 11/1968 | Laub et al. | 343/890 |
| 3,771,162 | 11/1973 | Dienes | 343/797 |
| 3,919,710 | 11/1975 | Fletcher | 343/797 |

FOREIGN PATENT DOCUMENTS

| | | | |
|---|---|---|---|
| 1,286,311 | 8/1972 | United Kingdom | 343/797 |

*Primary Examiner*—Eli Lieberman

*Attorney, Agent, or Firm*—Edward J. Norton; Robert L. Troike

[57] ABSTRACT

A linear/circularly polarized antenna system is provided by four conductive elements. The conductive elements are joined in pairs at their ends with the joined ends spaced by a conductive support member from a flat reflector. The lengths of the conductive elements of each dipole element are changed from being equal lengths of approximately a quarter operating frequency wavelength to one slightly longer and the other slightly less than a quarter wavelength to selectively change operation from that of a linearly polarized antenna to that of a circularly polarized antenna.

5 Claims, 9 Drawing Figures

Fig. 3.
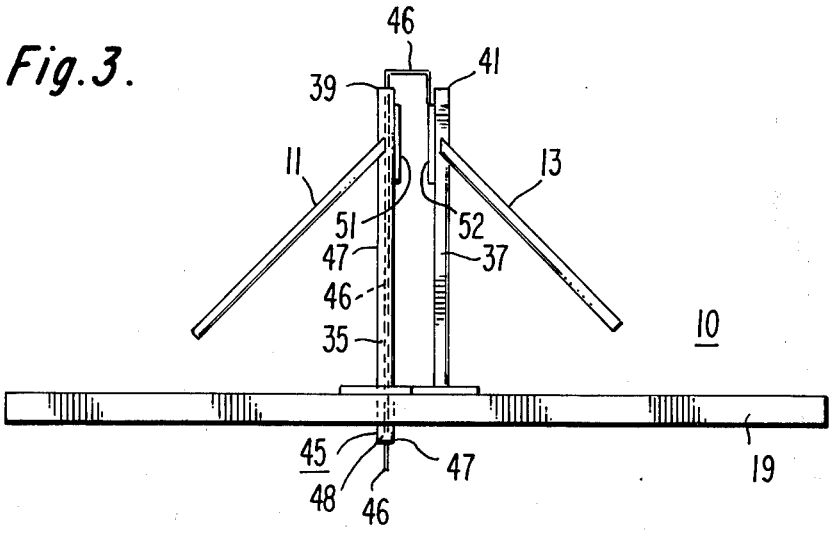
Fig. 4
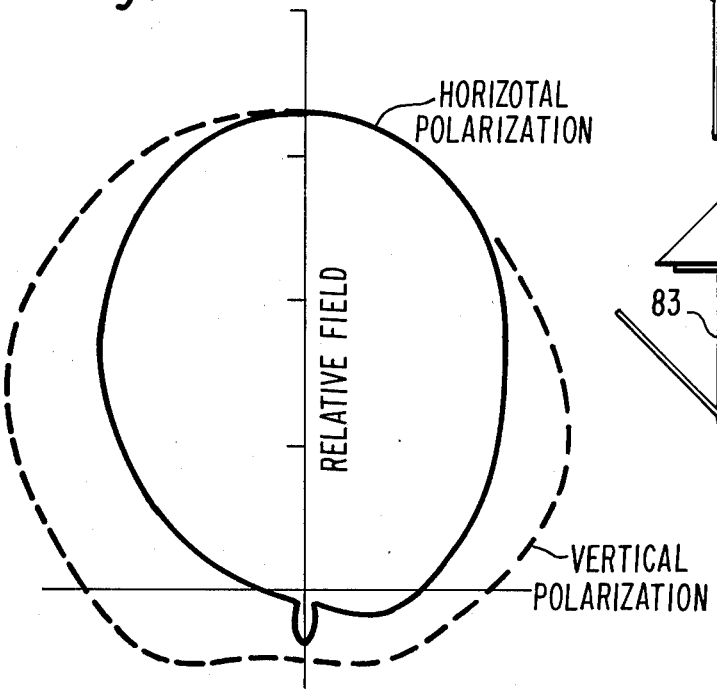
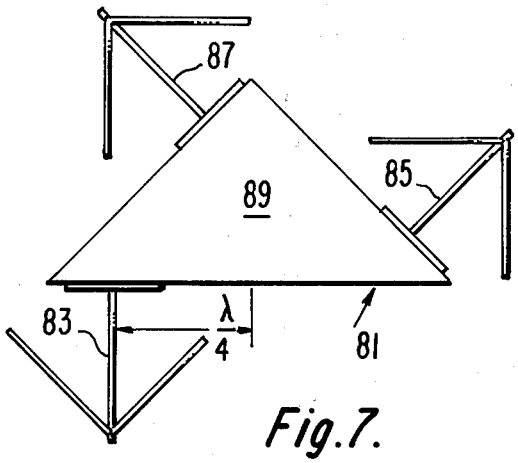
Fig. 7.
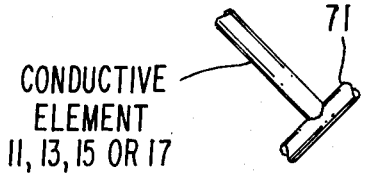
Fig. 6.
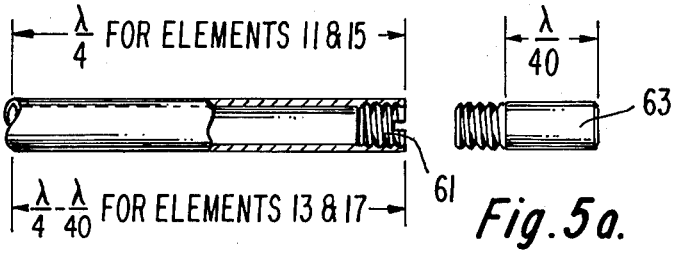
Fig. 5a.

LINEAR POLARIZATION

CIRCULAR POLARIZATION

LOW COST LINEAR/CIRCULARLY POLARIZED ANTENNA

BACKGROUND OF INVENTION

This invention relates to dipole antennas and more particularly to a low cost broadcast antenna for use in FM radio or in television broadcasting where the antennas are mounted about a support mast.

Although horizontally polarized television broadcasting has been almost exclusively used in the United States, it appears from some recent tests that circularly polarized broadcasting might well greatly improve television reception both in large metropolitan areas and fringe areas.

It is therefore desirable that a low cost horizontally polarized broadcasting antenna system be provided that is easily convertible to an antenna system that provides circularly polarized broadcasting. The antenna system must also be one which when mounted to conventional support masts, radiates signals in an omnidirectional pattern about the mast such that when this mast is erected in the center of a city, for example, substantially equal coverage is provided about the city. Although crossed dipole antenna systems are well known as exemplified by U.S. Pat. Nos. 3,896,450; 3,725,943 and 3,922,683, these antennas comprise complex support and feed structures and further are not easily convertible from linear to circular polarization.

BRIEF DESCRIPTION OF INVENTION

Briefly, an antenna system is provided by a reflective panel and a first and second pair of elements with each pair of elements spaced from the reflective panel by a support member. Each of the pair of elements includes a pair of generally orthogonally oriented conductive elements joined together at one end to one of the support members where the joined ends are located a distance approximately one-quarter wavelength from the reflective panel. A single feed for the antenna system is provided by a coaxial transmission line wherein the outer conductor is coupled to one of the pair of elements and the center conductor is coupled to the other of the pair of elements at a point near where the orthogonally oriented elements are joined together.

DESCRIPTION OF DRAWING

A more detailed description follows in conjunction with the following drawings wherein:

FIG. 3 is a top plan view of the antenna in FIG. 1 taken along lines 3—3, FIG. 4 is a field pattern for the antenna of FIG. 1 when arranged to broadcast circularly polarized signals, FIG. 5*a* is a sketch of one element of the pair of elements in FIG. 1 and of the adapter unit for converting from horizontal to circular polarization, FIG. 6 illustrates end loading of the elements in FIG. 1, and FIG. 7 is a top plan view of a system using the three antenna systems as described in FIG. 1 about a triangular tower to achieve an omnidirectional pattern.

DETAILED DESCRIPTION OF PREFERRED EMBODIMENT

Figure 1:
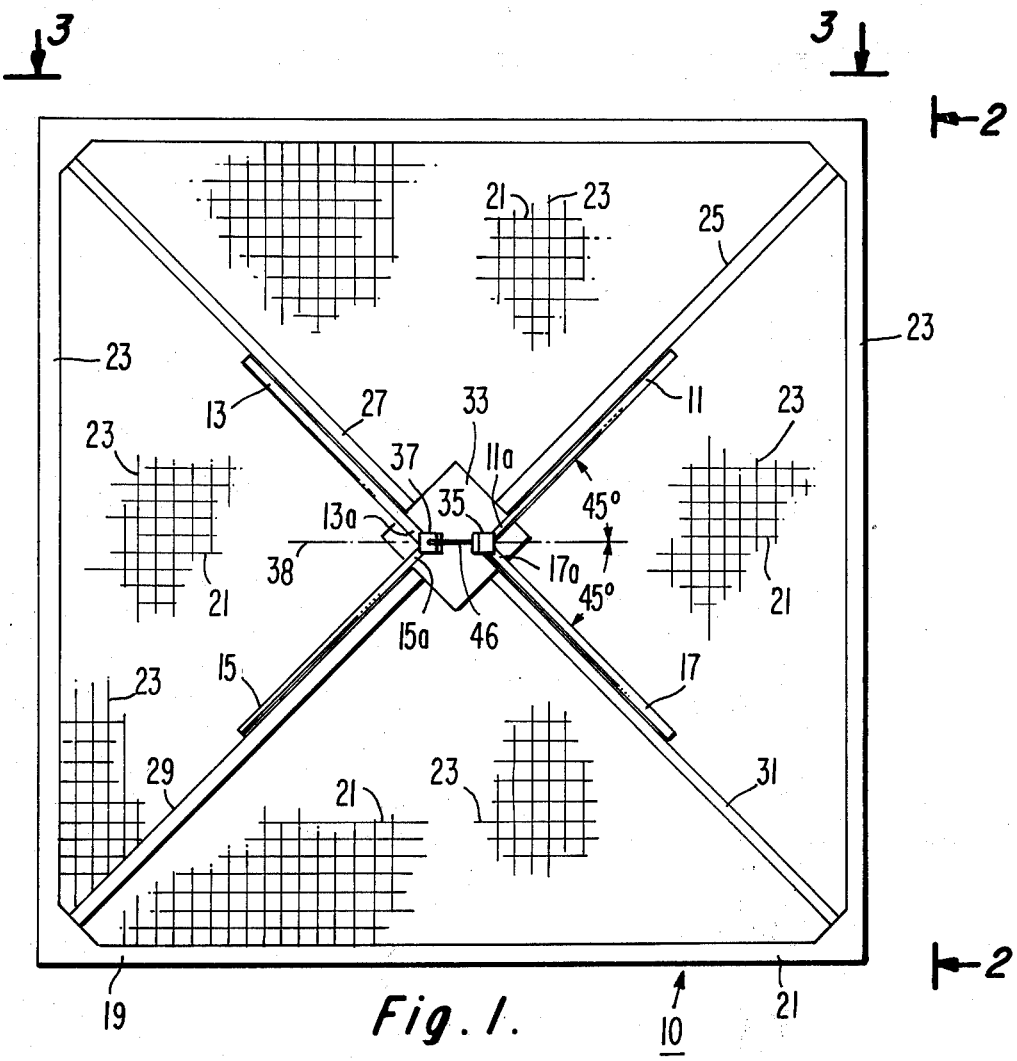
FIG. 1 is a front elevation view of the antenna according to a first embodiment of the present invention.
Figure 2:
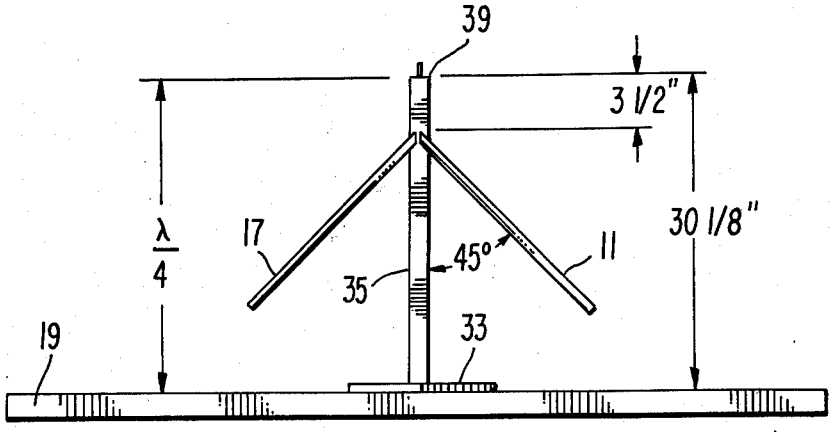
FIG. 2 is a side elevation view of the antenna in FIG. 1 taken along lines 2—2.

Referring to FIGS. 1 thru 3, there is illustrated a panel antenna system 10. The panel antenna system 10 includes four conductive elements 11, 13, 15 and 17 that are adapted to radiate RF signals and are spaced from a flat panel reflector 19. The reflector 19 is a square reflective metal member being approximately 0.7 wavelength high and 0.7 wavelength wide at the center operating frequency of the antenna system. All dimensions given in wavelengths herein are wavelengths taken at about the center operating frequency of the antenna system. The reflector 19 is a screen reflector made up of horizontally extending metallic reflecting elements 21, vertically extending metallic reflector elements 23, diagonally extending metallic reflecting elements 25, 27, 29, and 31, and a central metal plate 33. The conductive elements 11 and 17 are supported from the central metal plate 33 by hollow tubular conductive support member 35. The conductive elements 13 and 15 are supported from the central metal plate 33 by hollow tubular conductive support member 37. The support members 35 and 37 extend perpendicular to the reflector 19 a distance of approximately one-quarter wavelength. The support members 35 and 37 extend parallel to each other with their centers approximately 4½ (about 0.039 wavelength) inches apart. The conductive elements 11 and 17 are fixed to support 35 near the free end 39 and the conductive elements 13 and 15 are fixed to support 37 near the free end 41.

Referring to FIG. 1, the conductive element 11 extends from fixed end 11*a* at approximately a 45° angle in the vertical direction above a horizontal plane indicated by dashed lines 38. Dashed lines 38 are parallel to horizontal conductor elements 21. The conductive element 17 extends from fixed end 17*a* at approximately a 45° angle in the vertical direction below the horizontal plane defined by dashed lines 38. The conductive elements 11 and 17 form an angle in the vertical direction of approximately 90° with respect to each other. The conductive element 13 extends from a fixed end 13*a* at approximately a 45° angle in the vertical direction above the horizontal plane defined by dashed lines 38, as shown in FIG. 1. The conductive element 13 extends in a direction at approximately a 90° angle with respect to conductive element 11 and approximately 180° with respect to conductive element 17. The conductive element 15 extends from a fixed end 15*a* at approximately a 45° angle in the vertical direction below the horizontal plane defined by dashed lines 38 in FIG. 1. The conductive element 15 extends at approximately a 90° angle with respect to elements 13 and 17 and approximately a 180° angle with respect to element 11. All of the conductive elements 11, 13, 15 and 17 are angled back toward reflector 19 at approximately a 45° angle with respect to the supports 35 and 37 as shown in FIGS. 2 and 3.

The conductive elements 11, 13, 15 and 17 are fed by a single balun feed. A coaxial transmission line 45 comprising an outer conductor 47 and an insulated center conductor 46 is passed through tubular support 35 with the outer conductor 47 fixed to conductive support 35 and the inner conductor spaced from the support by the insulator 48. The center conductor 46 extends in insulated manner beyond end 39 of the support 35 and is coupled near end 41 of support 37. The quarter wavelength impedance transformation from the unbalanced end near the reflector 19 to the balanced end at the feed points is provided by the one-quarter wavelength supports 35 and 37. It is desirable for impedance matching that the feed points to the conductive elements 13 and 15 be approximately the same distance from the reflector 19 as the termination of the outer conductor 47 along support 35.

When the conductive elements 11, 13, 15 and 17 as described above are of equal length and are approximately one-quarter wavelength long from the feed end 11*a*, 13*a*, 15*a* and 17*a* to the respective free ends, a broad beam width linear polarized pattern is achieved. The conductive elements 11 and 17 form one dipole half and the conductive elements 13 and 15 form another dipole half. For an FM broadcast antenna operating at a center frequency of 101.5 $MH_z$, the antenna can have the following dimensions. The conductive elements 11, 13, 15 and 17 are about 28 inches long, 1.25 inches in diameter. The supports 35 and 37 are 30⅛ inches long and are 1½ inch square tubing. The supports 35 and 37 are spaced 3 inches apart. It was found that better performance was achieved with metal bars 51 and 52 added to the supports near the feed point as shown in FIG. 3. These bars were each 1 inch thick, 1¼ inches wide, and were 10¾ inches long. The same improvement may be achievable by placing the supports 35 and 37 closer together. The center conductor 46 was fixed to the end of the bar 52 where the conductive elements 13 and 15 were joined to support 37. The conductive elements 11, 13, 15 and 17 were fixed to supports 35 and 37 a distance of 26⅝ inches from reflector 19. The reflector 19 was 7 feet by 7 feet square.

It was found that the above described antenna was easily convertible to a circularly polarized antenna for FM or television applications by lengthening both conductive elements 11 and 15 about one fortieth of a wavelength ($\lambda/40$) and by shortening both conductive elements 13 and 17 about one fortieth of a wavelength ($\lambda/40$) so that the combined lengths of conductive elements 11 and 15 is about one tenth of a wavelength ($\lambda/10$) greater than the combined lengths of conductive elements 13 and 17. In this manner conductive elements 11 and 15 form a first center fed dipole slightly over a quarter wavelength long, and conductive elements 13 and 17 form a second center fed dipole slightly under a quarter wavelength long with both dipoles fed by the same single feed. In an actual FM antenna produced, the conductive elements 11 and 15 were each about 30 7/16 inches and the conductive elements 13 and 17 were each about 25 inches. The conductive elements were of the same diameter described previously. With the conductive elements fed in the manner shown and described above, they are fed with equal magnitudes and in phase quadrature. This phase quadrature is obtained by lengthening the one dipole made up of elements 11 and 15 for inductive impedance and shortening the other dipole made up of elements 13 and 17 for capacitive impedance. With the conductive elements angled as illustrated toward the reflector 19, the E and the H plane patterns are closer in beam width. This is desirable to reduce the axial ratio over a wide angle of radiation in both major planes. FIG. 4 illustrates the radiation patterns of the antenna discussed above operating as a circularly polarized antenna.

Figure 5B:
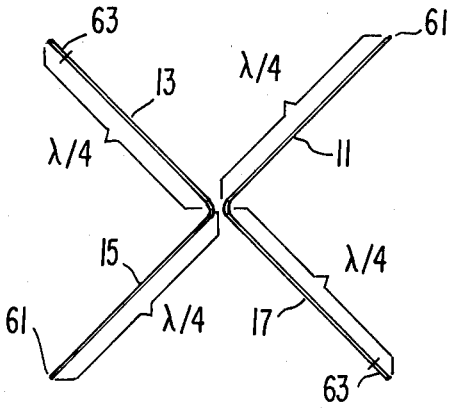
FIG. 5*b* is a diagram representing the respective lengths of the conductive elements for linear polarization.
Figure 5C:
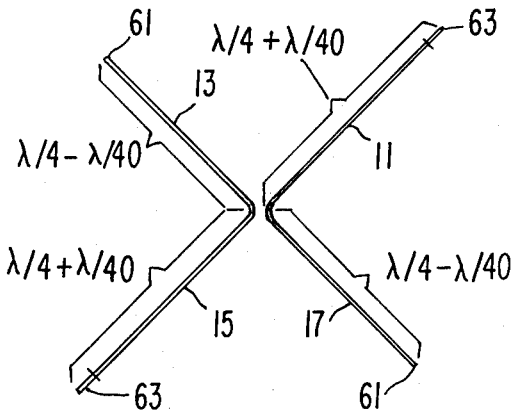
FIG. 5*c* is a diagram representing the respective length of the conductive elements for circular polarization.

Referring to FIG. 5, there is illustrated a manner in which the panel antenna system 10 may be converted from a linearly polarized antenna system to a circularly polarized antenna system. The conductive elements 11, 13, 15 and 17 are hollow pipes threaded on the inside at the free end. The conductive elements 11 and 15 are one-quarter wavelength long and have a threaded bolt plug 61 inserted flush with the end of the hollow pipe. When converting these conductive elements to function in the circularly polarized antenna system, the flush plug 61 is removed, and a threaded bolt 63 is threaded into place. The bolt 63 has a length beyond the threads approximately one fortieth of a wavelength long at an operating frequency of the antenna system. The conductive elements 13 and 17 each comprise a pipe one quarter wavelength long less one-fortieth of a wavelength ($\lambda/4$-$\lambda/40$) 10% shorter than the original length of the pipe for conductive elements 11 and 15. When operating to provide linear polarized radiation a bolt like that of 63 that is one fortieth of a wavelength beyond the threaded portion is inserted into the end of the shorter threaded pipe. When converting to circularly polarized operation, the flush plug 61 replaces the bolt 63 in the shorter pipe of conductive elements 13 and 17 and the bolt 63 is placed in one of the longer pipes of conductive elements 11 and 15. In this manner there are no loose parts and one need only to exchange parts of the antenna to convert from a linear polarized antenna system to a circularly polarized antenna system. FIG. 5*b* diagrams the respective lengths of elements 11, 13, 15 and 17 for linear polarization operation, and FIG. 5*c* diagrams the respective lengths for circular polarization.

Referring to FIG. 6, the free end of the elements 11, 13, 15 and 17 can be top loaded with rods 71 parallel to the reflector 19. This permits high power use when operating in both the linear or circularly polarized case. The rods reduce the voltage gradients in the high gradient regions. In this case the plugs 61 and 63 would be T-shaped with the stem of bolt 63 one fortieth of a wavelength longer than bolt 61 which has the cross member flush with the threads.

The antenna system as described above provides a sufficiently broad beam width pattern such that three of these panel antennas 10 can be mounted as illustrated in FIG. 7 to achieve an omnidirectional antenna system 81. Many of the broadcast towers are triangular. FIG. 7 is a top plan view illustrating three panel antennas 83 85, and 87 as described previously mounted, with a panel antenna system mounted to each side of the tower 89. The panel antennas 83, 85 and 87 are offset one-quarter of a wavelength from the center of each side as shown in FIG. 7.

In the description herein, the conductive elements were described as being angled approximately 45° toward the reflector with respect to the support member. It has been found that improved low axial ratio performance is achieved within a tolerance of about ± 5°.

Although the term wavelength as used herein referred to a wavelength at the center frequency it is obvious that usable performance can be achieved with the lengths at frequencies within the operating frequency band of the antenna. The term "circularly polarized" as used herein refers to elliptically polarized signals with low axial ratio such as 3 d.b. or less.

What is claimed is:

1. An antenna system operating over a given band of frequencies comprising:

a flat reflective panel, support means including a pair of separated support members extending generally orthogonal to said panel, a first pair of generally orthogonally oriented conductive elements joined together at one end to one of said support members a distance of about one-quarter wavelength at a given frequency within said given band of frequencies from said panel, at least one of said elements being at least about one-quarter wavelength long at said given frequency, a second pair of generally orthogonally oriented conductive elements joined together at one end to the other of said support members about said distance from said panel, at least one of said elements being at least about one-quarter wavelength long at said given frequency, each one of said pair of elements in said first pair extending in generally an opposite direction from one of the conductive elements in said second pair of elements, each of said conductive elements being inclined toward said reflective panel with each of said conductive elements having a conductive loading rod connected across the free end thereof, and a coaxial transmission line feed having an outer conductor coupled to one of said pair of orthogonally oriented elements and a center conductor coupled to the other of said pair of orthogonally oriented conductive elements at a point located approximately where said conductive elements are joined together to said support members.

2. The combination of claim 1 wherein said conductive elements are inclined toward said reflective panel at an angle of 45° ± 5°.

3. The combination of claim 2 wherein one of said conductive elements of each of said pair of elements is slightly longer than the other so that one of said elements behaves as an element greater than a one-quarter wavelength at a frequency within said band and said other of said conductive elements behaves as an element less than one-quarter wavelength at a frequency within said band.

4. The combination of claim 3 wherein said one conductive element is one fortieth of a wavelength longer than and said other conductive element is one fortieth of a wavelength shorter than a quarter wavelength at a frequency within said band.

5. The combination of claim 4 wherein said conductive rods are arranged parallel to said reflective panel.

* * * * *